US009169848B2

(12) United States Patent
Parmeter et al.

(10) Patent No.: US 9,169,848 B2
(45) **Date of Patent: *Oct. 27, 2015**

(54) APPARATUS AND SYSTEM FOR SEALING SUBMERSIBLE PUMP ASSEMBLIES

(71) Applicant: Summit ESP, LLC, Tulsa, OK (US)

(72) Inventors: Larry James Parmeter, Broken Arrow, OK (US); Brett Leamy, Claremore, OK (US); John Vanderstaay Kenner, Houston, TX (US); David Lunk, Big Cabin, OK (US); Keith Leon Johnson, Claremore, OK (US); Thomas John Gottschalk, Houston, TX (US)

(73) Assignee: Summit ESP, LLC, Tulsa, OK (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/657,835

(22) Filed: Mar. 13, 2015

(65) Prior Publication Data

US 2015/0184671 A1 Jul. 2, 2015

Related U.S. Application Data

(63) Continuation of application No. 14/274,233, filed on May 9, 2014, now Pat. No. 9,017,043.

(60) Provisional application No. 61/974,907, filed on Apr. 3, 2014, provisional application No. 61/822,085, filed on May 10, 2013.

(51) Int. Cl.

| | |
|---|---|
| ***F04D 29/10*** | (2006.01) |
| ***F04D 13/08*** | (2006.01) |
| ***F04D 29/047*** | (2006.01) |

(52) U.S. Cl.

CPC ..... *F04D 29/106* (2013.01); *F04D 13/08* (2013.01); *F04D 29/047* (2013.01)

(58) Field of Classification Search

CPC ..... F04D 29/12; F04D 29/04; F04D 29/047; F04D 29/08; F04D 29/086; F04D 29/106; F04D 13/08

See application file for complete search history.

(56) References Cited

U.S. PATENT DOCUMENTS

| | | | | |
|---|---|---|---|---|
| 2,363,420 | A * | 11/1944 | Howard | 417/423.3 |
| 5,367,214 | A * | 11/1994 | Turner, Jr. | 310/87 |
| 5,404,061 | A * | 4/1995 | Parmeter | 310/87 |
| 2005/0087343 | A1 * | 4/2005 | Du et al. | 166/369 |
| 2007/0140876 | A1 * | 6/2007 | Parmeter et al. | 417/423.11 |
| 2007/0207046 | A1 * | 9/2007 | Du et al. | 417/423.3 |
| 2007/0277969 | A1 * | 12/2007 | Hall et al. | 166/105 |
| 2010/0078177 | A1 * | 4/2010 | Parmeter et al. | 166/369 |
| 2010/0218995 | A1 * | 9/2010 | Sexton et al. | 175/57 |

* cited by examiner

*Primary Examiner* — Charles Freay
*Assistant Examiner* — Kenneth J Hansen
(74) *Attorney, Agent, or Firm* — Frederic Dorwart, Lawyers; Penina Michlin Chiu

(57) ABSTRACT

An apparatus, system and method for sealing an electrical submersible pump assembly are described. An electric submersible pump (ESP) system for pumping solid-laden fluid comprises a thrust chamber of an ESP seal section, the thrust chamber sealed from well fluid on a downstream side by a stationary sand barrier and on an upstream side by a mechanical seal, the thrust chamber further comprising, a rotatable shaft extending axially through the thrust chamber, a head tubularly encasing the thrust chamber and threadedly coupled to a centrifugal pump intake, and a diamond-coated hydrodynamic bearing set inside the thrust chamber, wherein well fluid enters and exits the chamber through cross-drilled apertures in the head of the chamber, and wherein the well fluid forms a hydrodynamic film between the bearing set.

20 Claims, 12 Drawing Sheets

APPARATUS AND SYSTEM FOR SEALING SUBMERSIBLE PUMP ASSEMBLIES

CROSS REFERENCE TO RELATED APPLICATIONS

The present application is a continuation of U.S. Ser. No. 14/274,233 to Parmeter et al., filed May 9, 2014 and entitled APPARATUS AND SYSTEM FOR SEALING SUBMERSIBLE PUMP ASSEMBLIES, which claims the benefit of U.S. Provisional Application No. 61/822,085 to Parmeter et al., filed May 10, 2013 and entitled "APPARATUS, SYSTEMS AND METHODS FOR SEALING SUBMERSIBLE PUMP ASSEMBLIES," and U.S. Provisional Application No. 61/974,907 to Lunk et al., filed Apr. 3, 2014 and entitled "APPARATUS, SYSTEM AND METHOD FOR A HYDRODYNAMIC THRUST BEARING FOR USE IN HORIZONTAL PUMP ASSEMBLIES," which are each hereby incorporated by reference in their entireties.

BACKGROUND OF THE INVENTION

1. Field of the Invention

Embodiments of the invention described herein pertain to the field of submersible pumps. More particularly, but not by way of limitation, one or more embodiments of the invention enable an apparatus, system and method for sealing submersible pump assemblies.

2. Description of the Related Art

Electric submersible pump (ESP) assemblies are used to artificially lift fluid to the surface in deep underground wells such as oil, water or gas wells. Exemplary downhole oil well fluid, for example, may include a mixture of oil, water and natural gas. A typical ESP assembly is shown in FIG. 1, consisting of electric motor 100, conventional seal section 110, pump intake 120 and centrifugal pump 130, which are all connected together with rotatable shafts. Electric motor 100 supplies torque to the shafts, which provides power to pump 130.

Submersible pumps operate while submerged in the fluid to be pumped. The fluid enters the assembly at pump intake 120 and is lifted to the surface through production tubing 140. In order to function properly, electric motor 100 must be protected from well fluid ingress, and conventional seal section 110 provides a barrier to keep the well fluid from the motor and its motor oil. In addition, conventional seal section 110 supplies oil to the motor, provides pressure equalization to allow for expansion of motor oil in the well bore, and carries the thrust of pump 130 through the use of thrust bearings. A conventional multi-chamber seal section is further illustrated in FIG. 11. Conventional seal section 110 of FIG. 11 includes conventional head 1125, three conventional seal chambers 1130, a conventional thrust chamber 1120 and conventional base 1135. Conventional seal chambers 1130 are attached to one another and conventional thrust chamber 1120 by barstock guides 1155. As illustrated in FIG. 11, conventional thrust chamber 1120 is located at the bottommost section of conventional seal chamber 110 and connected to motor 100 by conventional base 1135.

In many instances, naturally occurring sand is pulled into the pump assembly along with the well fluid and can accumulate in production tubing 140. When the pump is shut down, the sand may fall back down through the pump assembly and accumulate in conventional head 1125, at the top of seal section 110, which is traditionally open to the accumulation of debris, and includes conventional mechanical seal 1110 and conventional vent port 1105. As shown in FIG. 11, sand can accumulate at the top of conventional mechanical seal 1110 due to conventional seal section 110's open design, destroying mechanical seal 1110.

This accumulation of sand may also plug the conventional vent port 1105, which vents to conventional mechanical seal 1110. Vent ports function to provide an outlet for expanding motor oil into the well bore, in order to maintain equalized pressure. Pressure equalization may be accomplished by utilizing a u-tube or elastomeric bag design. In either case, the expanding oil is released through an internal check valve located inside conventional vent port 1105. If the vent port is blocked off by sand, conventional seal section 110 cannot equalize pressure, causing a pressure build up inside conventional seal section 110, such that the mechanical seal 1110 faces may eventually separate. If this occurs, well fluid and sand will enter the clean oil section of conventional seal section 110 (upstream of conventional mechanical seal 1110), impeding the seal's proper function which may lead to failure of the pump.

Accumulation of sand may also prevent well fluid from making contact with the faces of mechanical seal 1110 of conventional seal section 110. Mechanical seal 1110 faces must be in contact with well fluid to remain cool during operation. In the instance that sand compacts around the mechanical seal and prevents heat transfer with the well fluid, the sealing faces will overheat and cause failure of the seal whether or not the vent port is plugged. In addition, conventionally a bronze bushing (not shown) is located in conventional head 1125, just below the mechanical seal, to provide radial support. Well fluid contamination and sand will rapidly destroy the bushing, causing a catastrophic failure due to loss of radial shaft support.

As is apparent from the drawbacks of conventional designs, seal sections of submersible pump assemblies are unduly susceptible to damage and contamination by sand and well fluid. One conventional approach to address this drawback has been to add a plate over the top of conventional head 1125. Such plates capture a portion of sand that would otherwise fall into the seal section, but they also prevent cooling well fluid from exchanging heat with the mechanical seal. In addition, plates over the seal section do not adequately prevent sand from entering, as they are prone to leaks.

Another approach to address this drawback has been to include multiple seal chambers in order to provide redundancy. As shown in FIG. 11, three conventional seal chambers 1130 are included in conventional seal section 110. In multiple chamber designs, thrust bearings are conventionally located at the bottom most section of the seal assembly, close to the motor in conventional thrust chamber 1120. In FIG. 11, a conventional upthrust bearing 1150, conventional thrust runner 1145 and conventional downthrust bearing 1140 are included in conventional thrust chamber 1120. As shown in FIG. 11, conventional thrust chamber 1120 is in close proximity to motor 100. With the multi-chamber approach, if one chamber should fail and allow well fluid to enter that chamber, the succeeding chamber will still isolate well fluid and the conventional bearings 1140, 1150 remain protected from contamination until the last chamber is breached. However, the result of the multi-chamber designs is that the shaft is very long and slender, which may cause incipient buckling. If this occurs, the side load capacity of the bronze bushings may be overcome as the shaft tries to buckle, causing pump failure.

Additionally, the location of conventional downthrust thrust bearing 1140, conventional thrust runner 1145 and conventional upthrust bearing 1150 in close proximity to the motor exposes the bearings to excessive amounts of heat. The conventional thrust bearings 1140, 1150, traditionally located at the bottom-most section of the seal assembly, sit immersed in clean motor oil to handle the thrust of the pump. Thrust bearings in the seal section carry the axial thrust and maintain shaft alignment. Hydrodynamic bearings are the most commonly implemented thrust bearings in submersible pump applications.

A conventional hydrodynamic bearing includes two round disks, which are usually submerged in a cavity of clean motor oil. One disk is fixed, while the other is turned by the shaft in rotation about the central axis of the fixed disk. An exemplary conventional thrust bearing of the prior art is illustrated in FIGS. 12A and 12B. Conventional downthrust bearing 1140 is illustrated in FIGS. 12A and 12B, but traditionally, conventional upthrust bearing 1150 would be identical except installed in conventional seal section 110 facing in the opposite direction of conventional downthrust bearing 1140. In some approaches, the fixed disk (conventional downthrust and upthrust bearings 1140, 1150) is designed with bronze pads. The rotating disk pulls motor oil between the pads and the stationary disk. As long as there is motor oil between the surfaces, the thin film of fluid creates separation between the disks with hydrodynamic lift. To function properly, the surfaces of hydrodynamic bearings must be flat and smooth. A typical hydrodynamic thrust bearing is usually designed to operate with a fluid thickness of between about 0.001 and 0.0004 inches. Any impurities that are thicker than the oil film between the disks, such as sand in the motor oil, can cause surface damage to the bearings. Resulting friction between the disks reduces or eliminates their hydrodynamic properties. Contamination of the motor oil between the disks, for example with sand, is common due to typical oil field conditions and oil or water pump requirements. Placing the disks in a protected cavity usually means locating the disks closer to the motor, exposing the disks to increased heat.

The rotating disk of a hydrodynamic thrust bearing is typically a hard material such as tungsten carbide. The stationary disk, conventional downthrust bearing 1140 and conventional upthrust bearing 1150, typically include softer metal pads made of bronze. However, bronze is only capable of carrying a load of about 500 pounds per square inch. There is often insufficient space to include large enough copper pads on the stationary disk to carry the required loads.

Conventional thrust bearings are not well suited for submersible pump applications since they must be operated in a cavity of clean motor oil uncontaminated by sand, dirt or water. In submersible pump applications where solid laden fluid is pumped, this means placing the thrust bearings close to the motor in a cavity of clean motor oil, which is not an ideal location for carrying thrust and maintaining shaft alignment.

Thus, it is apparent that conventional sealing techniques do not satisfactorily provide protection from sand contamination in submersible pump assemblies. Therefore, there is a need for an additional apparatus, system and method for sealing submersible pump assemblies.

BRIEF SUMMARY OF THE INVENTION

One or more embodiments of the invention enable an apparatus, system and method for sealing submersible pump assemblies.

An apparatus, system and method for sealing submersible pump assemblies are described. An illustrative embodiment of a seal section for an electric submersible pump assembly comprises a rotatable shaft extending axially through a seal section, a head tubularly encasing a top portion of the seal section and threadedly coupled to a centrifugal pump intake, wherein the head further comprises, at least one well-fluid entrance aperture proximate to a bearing set, the entrance aperture extending radially through a wall of the head, and at least one well-fluid exit aperture proximate to a mechanical seal and extending radially through the wall of the head, a stationary sand barrier downstream of the mechanical seal, the sand barrier sealedly coupled to the rotatable shaft on an inner diameter and the head on an outer diameter, the hydrodynamic bearing set located between the sand barrier and the mechanical seal, the hydrodynamic bearing set comprising a thrust bearing fixedly attached to the head and a thrust runner keyed to the rotatable shaft, and a motor-oil vent port located upstream of the mechanical seal and extending radially through the wall of the head from a communication port. In some embodiments, the thrust bearing and thrust runner each comprise a plurality of diamond-coated pads circumferentially disposed about a locking plate. In some embodiments, the sand barrier further comprises an o-ring on an outer diameter and a lip seal on an inner diameter. In some embodiments, a space between the thrust bearing and thrust runner is between about 0.00001 and 0.005 inches thick.

An illustrative embodiment of an electric submersible pump (ESP) system for pumping solid-laden fluid comprises a thrust chamber of an ESP seal section, the thrust chamber sealed from well fluid on a downstream side by a stationary sand barrier and on an upstream side by a mechanical seal, the thrust chamber further comprising, a rotatable shaft extending axially through the chamber, a head tubularly encasing the thrust chamber, the head threadedly coupled to a centrifugal pump intake, and a diamond-coated hydrodynamic bearing set inside the thrust chamber, wherein well fluid enters and exits the chamber through cross-drilled apertures in the head, and wherein the well fluid forms a hydrodynamic film between the bearing set. In some embodiments, the system further comprises a check valve located upstream of the chamber and extending radially through the head, the check valve fluidly coupled to a communication port and configured to vent expanding motor oil. In some embodiments, the bearing set comprises a bearing pad, the bearing pad further comprising a facing table of polycrystalline diamond integrally bonded to a substrate.

An illustrative embodiment of an apparatus for absorbing a thrust of an electric submersible pump (ESP) comprises an ESP configured to pump a well fluid, an electric motor operatively coupled to the ESP, the motor operating to rotate a shaft of the ESP, a seal section located between the ESP and the motor, the seal section comprising, a stationary thrust bearing comprising a first plurality of diamond coated pads arranged circumferentially about a thrust bearing locking plate, a thrust runner paired with the stationary thrust bearing and configured to rotate with the shaft, the thrust runner comprising a second plurality of diamond coated pads arranged circumferentially about a thrust runner locking plate, and wherein the well fluid forms a hydrodynamic film between the first plurality of diamond coated pads and the second plurality of diamond coated pads during operation of the motor. In some embodiments, the thrust runner comprises nine pads and the thrust bearing comprises nine pads. In some embodiments, the first and second plurality of diamond coated pads comprise a coating of leached diamond. In some embodiments, the seal section comprises a single stationary thrust bearing and a single thrust runner.

In further embodiments, features from specific embodiments may be combined with features from other embodiments. For example, features from one embodiment may be combined with features from any of the other embodiments.

In further embodiments, additional features may be added to the specific embodiments described herein.

BRIEF DESCRIPTION OF THE DRAWINGS

The above and other aspects, features and advantages of the invention will be more apparent from the following more particular description thereof, presented in conjunction with the following drawings wherein.

Figure 1:
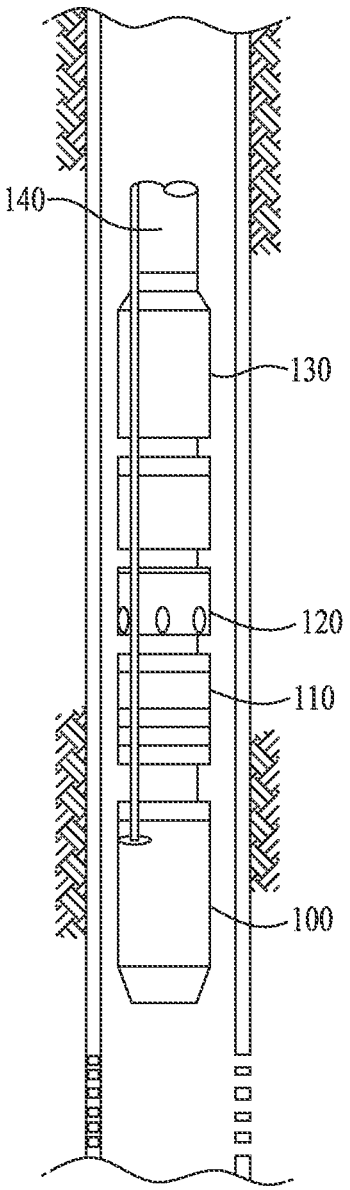
FIG. 1 PRIOR ART
FIG. 1 is a schematic side view of a conventional electric submersible pump assembly of the prior art.

While the invention is susceptible to various modifications and alternative forms, specific embodiments thereof are shown by way of example in the drawings and may herein be described in detail. The drawings may not be to scale. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION

An apparatus, system and method for sealing submersible pump assemblies will now be described. In the following exemplary description, numerous specific details are set forth in order to provide a more thorough understanding of embodiments of the invention. It will be apparent, however, to an artisan of ordinary skill that the present invention may be practiced without incorporating all aspects of the specific details described herein. In other instances, specific features, quantities, or measurements well known to those of ordinary skill in the art have not been described in detail so as not to obscure the invention. Readers should note that although examples of the invention are set forth herein, the claims, and the full scope of any equivalents, are what define the metes and bounds of the invention.

As used in this specification and the appended claims, the singular forms "a", "an" and "the" include plural referents unless the context clearly dictates otherwise. Thus, for example, reference to an aperture includes one or more apertures.

As used in this specification and the appended claims, the term "diamond" includes true diamond as well as other natural or manmade diamond-like carbon materials, which may have a crystalline, polycrystalline and/or graphite structure. "Diamond coating" and "diamond coated" as used herein is intended to encompass composites of diamond in combination with other materials and having at least 5% pure diamond by weight.

As used herein, the terms "sand", "debris", "dirt", "particles", and "solids" are used interchangeably to refer to solid contamination in pumped well fluid.

As used herein, the term "outer" or "outward" means the radial direction away from the shaft of the ESP pump assembly. In the art, "outer diameter" and "outer circumference" are sometimes used equivalently. As used herein, the outer diameter is used to describe what might otherwise be called the outer circumference of a pump component such as a thrust bearing, thrust runner or sand barrier.

As used herein, the term "inner" or "inward" means the radial direction towards the shaft of the ESP pump assembly. In the art "inner diameter" and "inner circumference" are sometimes used equivalently. Herein, the inner diameter is used to describe what might otherwise be called the inner circumference of a pump component such as a thrust bearing, thrust runner or sand barrier.

"Coupled" refers to either a direct connection or an indirect connection (e.g., at least one intervening connection) between one or more objects or components. The phrase "directly attached" means a direct connection between objects or components.

"Downstream" refers to the direction substantially with the principal flow of well fluid when the submersible pump assembly is in operation. The "top" of a component of an ESP assembly refers to the downstream portion of that component. By way of example but not limitation, in a vertical downhole ESP assembly, the downstream direction may be towards the surface of the well.

"Upstream" refers to the direction substantially opposite the principal flow of well fluid when the submersible pump assembly is in operation. The "bottom" of a component of an ESP assembly refers to the upstream portion of that component. By way of example but not limitation, in a vertical downhole ESP assembly, the upstream direction may be opposite the surface of the well.

One or more embodiments of the invention provide an apparatus, system and method for sealing submersible pump assemblies. While for illustration purposes the invention is described in terms of a submersible pump assembly, nothing herein is intended to limit the invention to that embodiment. The invention may be equally applicable to any pump assembly and/or electric motor which must be sealed from fluids and/or particulate contamination, such as a horizontal surface pump assembly.

The invention disclosed herein includes an apparatus, system and method for sealing submersible pump assemblies. Illustrative embodiments improve the performance of an ESP seal section, particularly when pumping solid-laden well fluid. Improvements to the seal section of a submersible pump assembly may include a fixed (stationary) sand barrier in the head of the seal section, downstream of a mechanical seal, the sand barrier sealed from leaks to prevent sand from falling down production tubing and accumulating on the mechanical seal. A diamond-coated thrust bearing and thrust runner may be located in a thrust chamber created between the sand barrier and the mechanical seal, in the seal section head away from the motor, to reduce buckling of the assembly. Well fluid flowing through this thrust chamber may serve as a hydrodynamic fluid for the bearing set, which bearing set, unlike conventional hydrodynamic bearings, need not be located in a clean chamber of motor oil. One or more horizontal apertures in the head of the seal section may allow well fluid to lubricate and cool the thrust bearing and/or mechanical seal, act as a hydrodynamic fluid and/or flush away accumulated debris. A vent port for venting expanding motor oil, may be located in the wall of the head of the seal section upstream of the mechanical seal, run substantially perpendicular to the shaft, be fluidly coupled to the communication port and/or prevent sand from plugging the communication port of the seal section. A tungsten carbide bushing set upstream of the mechanical seal may provide radial support in contaminated well fluid conditions.

Figure 2:
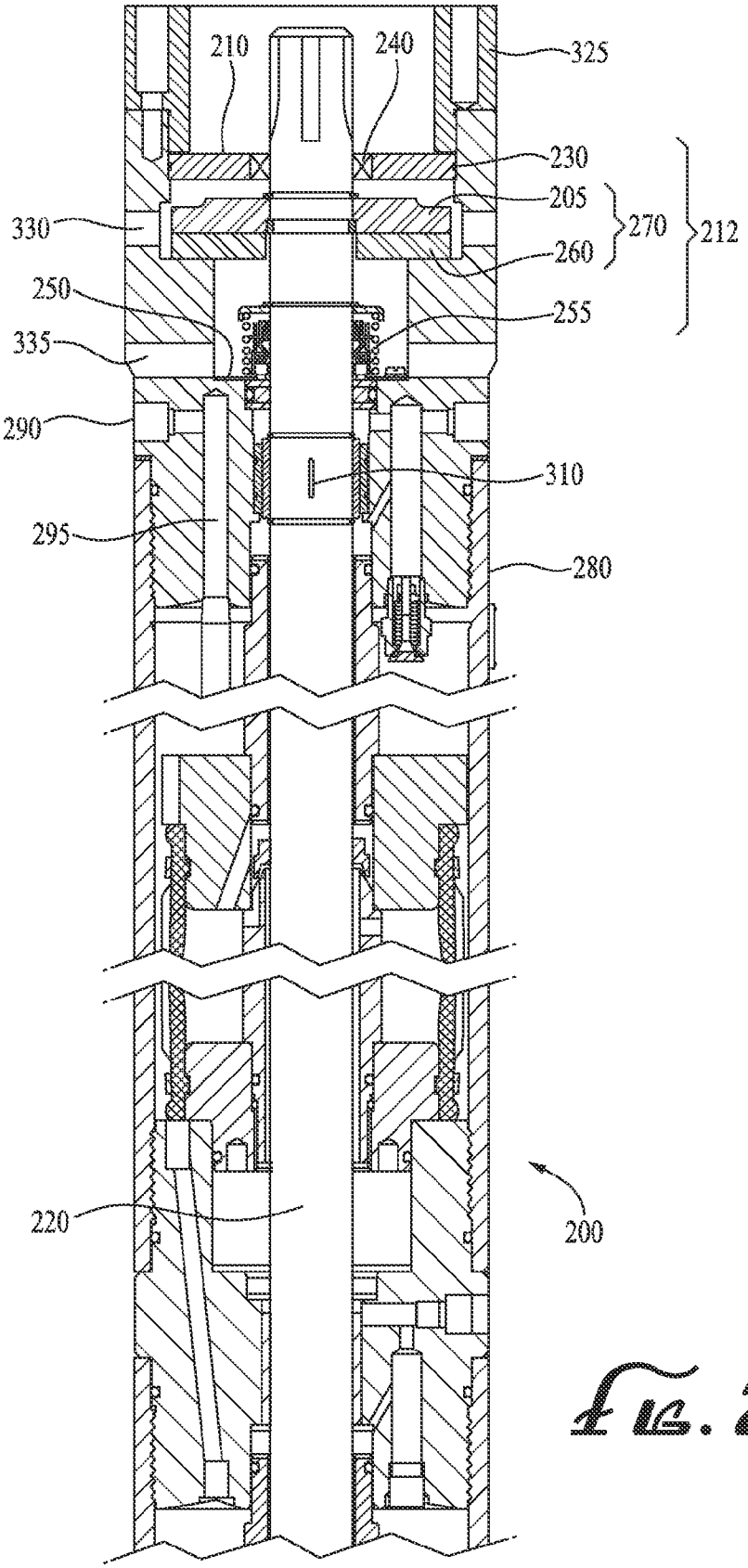
FIG. 2 is an illustrative embodiment of a sectional view of a seal section of a submersible pump assembly.
Figure 3A:
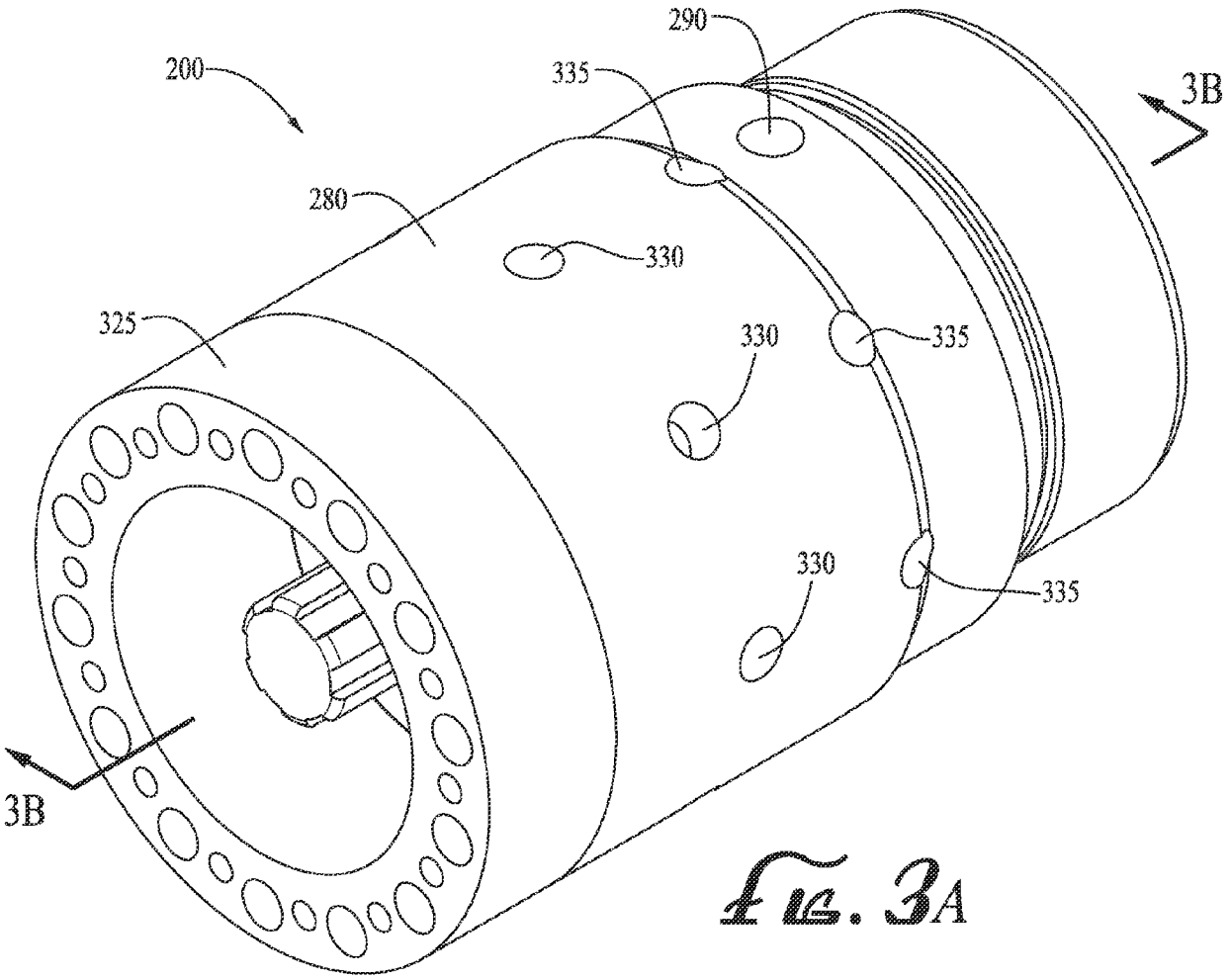
FIG. 3A is an illustrative embodiment of a perspective view of a top of a seal section.
Figure 3B:
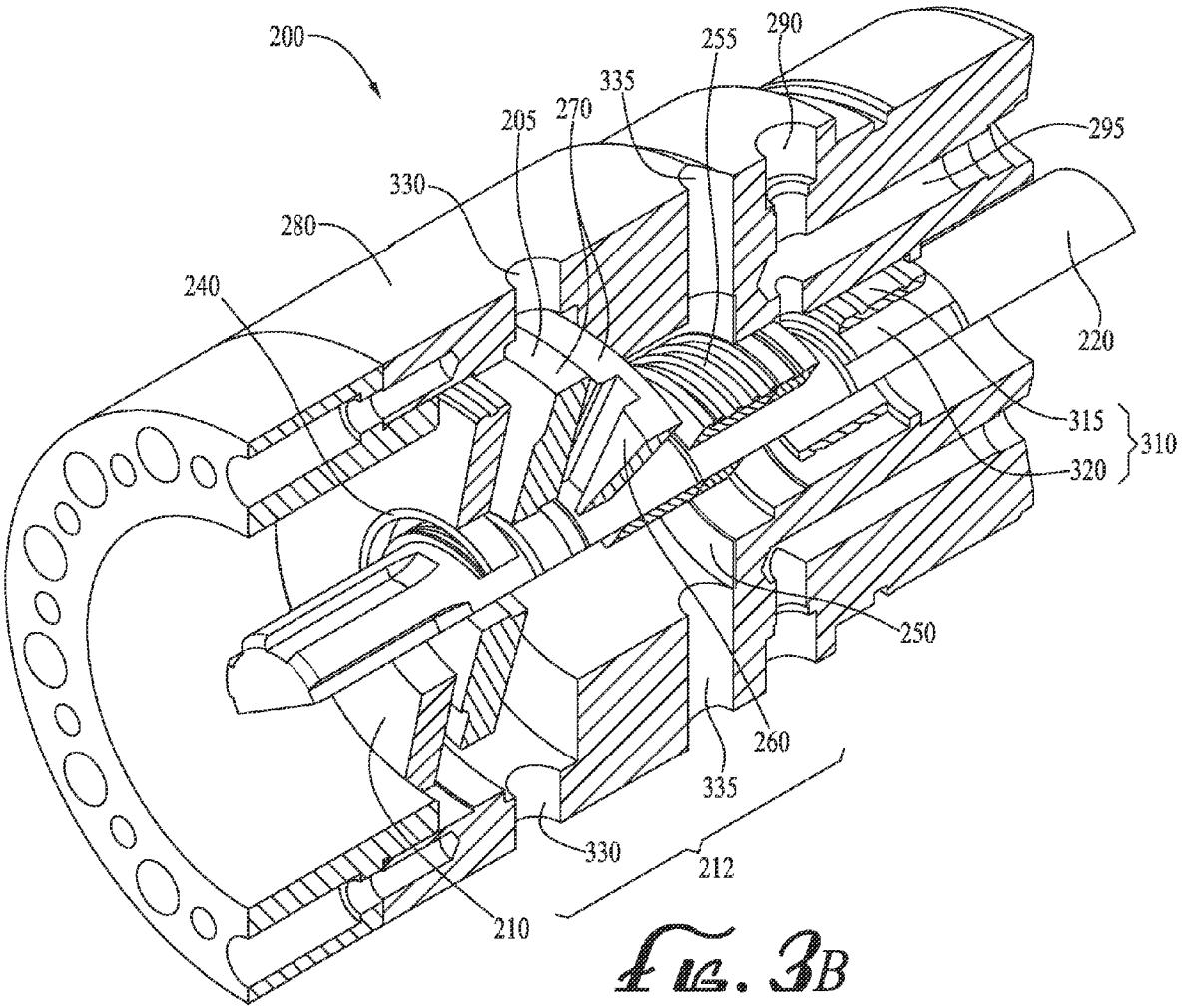
FIG. 3B is a cross sectional view taken along line 3B-3B of FIG. 3A of an illustrative embodiment of a top of seal section.

The invention includes an apparatus for sealing submersible pump assemblies. FIGS. 2, 3A and 3B illustrate a top portion of a seal section of illustrative embodiments. Seal section 200 may be part of an ESP assembly and coupled to an electric motor well known to those of skill in the art on an upstream side, and a centrifugal pump, ESP charge pump and/or pump intake well known to those of skill in the art on a downstream side. For example, the electric motor may be a two-pole, three-phase, squirrel cage induction motor, or a permanent magnet motor. The ESP pump may be a multistage centrifugal pump. The intake for the ESP assembly may be a bolted-on or integral intake.

Seal section 200 may be a seal section of a submersible pump assembly located in a downhole well, such as an oil, water and/or gas well. As shown in FIG. 2, seal section 200 includes shaft 220 running axially through the center of seal section 200. During operation of the ESP assembly, shaft 220 rotates about its vertical axis. The ESP motor and ESP pump of the ESP assembly similarly contain rotating shafts, which are all connected such that the motor turns the pump and the pump lifts fluid to the surface of the well. Head 280 encases the top portion of seal section 200 in a tubular fashion. Head 280 may comprise steel bar stock. In some embodiments the bar stock may have a 4 inch diameter. Head 280 may be machined and its top side and threaded to the ESP pump, ESP charge pump and/or ESP intake. The bottom side of head 280 may be pinned, bolted, threaded or otherwise attached to the first seal chamber of seal section 200. In some embodiments, head 280 is attached, threaded and/or bolted at a downstream side to the pump intake. The base (not shown) of seal section 200 may be threaded and/or bolted to the electric motor the ESP assembly.

Sand Barrier

As shown in FIGS. 2 and 3B, seal section 200 may include sand barrier 210. Sand barrier 210 may be fixed in place and/or may not rotate with shaft 220. Sand barrier 210 may be sealed from leaks, such that well fluid and/or its associated solids may not fall upstream, down the production tubing, and accumulate on mechanical seal 250 and/or mechanical seal faces 255. Instead, sand barrier 210 may catch accumulating debris, keeping the debris away from more vital seal section components, such as thrust bearing 260, thrust runner 205 and mechanical seal 250. The outer circumference (outer diameter) of sand barrier 210 may be pressed against the inner side of the wall of head 280 and sealed with gasket 230, such as an o-ring. Gasket 230 may be inserted into an o-ring groove in head 280. The inner circumference (inner diameter) of sand barrier 210 may be sealed against shaft 220 with radial shaft seal 240 (lip seal) to prevent sand from leaking through the barrier while still allowing shaft 220 to rotate. Sand barrier 210 may prevent sand, well fluid and/or other particulates carried in well fluid from bypassing the barrier and collecting on thrust bearing 260, thrust runner 205 and/or mechanical seal 250. In some embodiments, sand barrier 210 is stainless steel grade 316 and about ⅜ inch thick. Adapter 325 may be located at, on or near the top of head 280 and assists in holding sand barrier 210 in place, for example by preventing shaking or sliding of sand barrier 210 and/or by wedging or sandwiching sand barrier 210 against head 280.

Seal Section Thrust Chamber

Bearing set 270, including thrust bearing 260 and thrust runner 205, may be located in thrust chamber 212 of seal section 200, the thrust chamber 212 created by and located between sand barrier 210 and mechanical seal 250. Bearing set 270 (thrust bearing 260 and thrust runner 205) may reduce or eliminate incipient buckling of shaft 220, even in the instances where there are multiple seal chambers in the pump assembly. Thrust bearing 260 and thrust runner 205 may be located in thrust chamber 212 substantially adjacent and/or downstream of mechanical seal 250 within head 280, and/or between mechanical seal 250 and sand barrier 230. Locating thrust bearing 260 and thrust runner 205 near and/or in the top (downstream) portion of seal 200 and/or in head 280, rather than in the bottom-most seal section chamber (adjacent to the base) next to the motor, eliminates buckling concerns and removes thrust bearing 260 and thrust runner 205 from the heat generated by the pump's motor. In some embodiments, placing bearing set 270 in thrust chamber 212 keeps bearing set 270 in excess of about 100 degrees Fahrenheit cooler as compared to conventional locations in the base of the seal section and/or close to the motor of the pump assembly. Instead of conventional bearings, low cost spacers may be included in the bottom-most seal chamber by the motor, to momentarily absorb upthrust and keep the shaft in the correct position during start-up. Thrust bearing 260 and thrust runner 205 may be hydrodynamic thrust bearings making use of well fluid as the hydrodynamic film. In such embodiments, thrust bearing 260 and/or thrust runner 205 may be diamond coated and/or solid tungsten carbide for increased strength. In some embodiments, only a single thrust bearing 260 and a single thrust runner 205 are necessary, rather than conventional arrangements requiring separate upthrust and downthrust bearings.

Thrust Chamber Apertures

Entry aperture 330 and exit aperture 335 may be cross-drilled into head 280 of seal section 200 to allow well fluid, otherwise sealed off by sand barrier 230, to cool and lubricate thrust bearing 260, thrust runner 205 and/or mechanical seal 250. Entry aperture 330 may be located proximate and/or radially outwards from bearing set 270. Exit aperture 335 may be located proximate and/or radially outwards from mechanical seal 250. In some embodiments, apertures 330, 335 may extend in a radial direction, as judged from shaft 220, through the wall of head 280. Apertures 330, 335 may be cross-drilled substantially perpendicular to shaft 220, extending entirely through the wall of head 280. Entry aperture 330 may allow well fluid to lubricate and cool thrust bearing 260, thrust runner 205 and/or mechanical seal 250 without allowing the well fluid to contaminate the electrical motor and/or without allowing sand to accumulate on mechanical seal 250. Exit aperture 335 may allow accumulated debris to be flushed away from mechanical seal 250 and/or mechanical seal faces 255 with well fluid when the pump assembly is stopped. In such instances, well fluid may back flow through the bottom end of the pump due to gravity and flush any debris (solids) around mechanical seal 250 and/or mechanical seal faces 255.

Bearings

Figure 10:
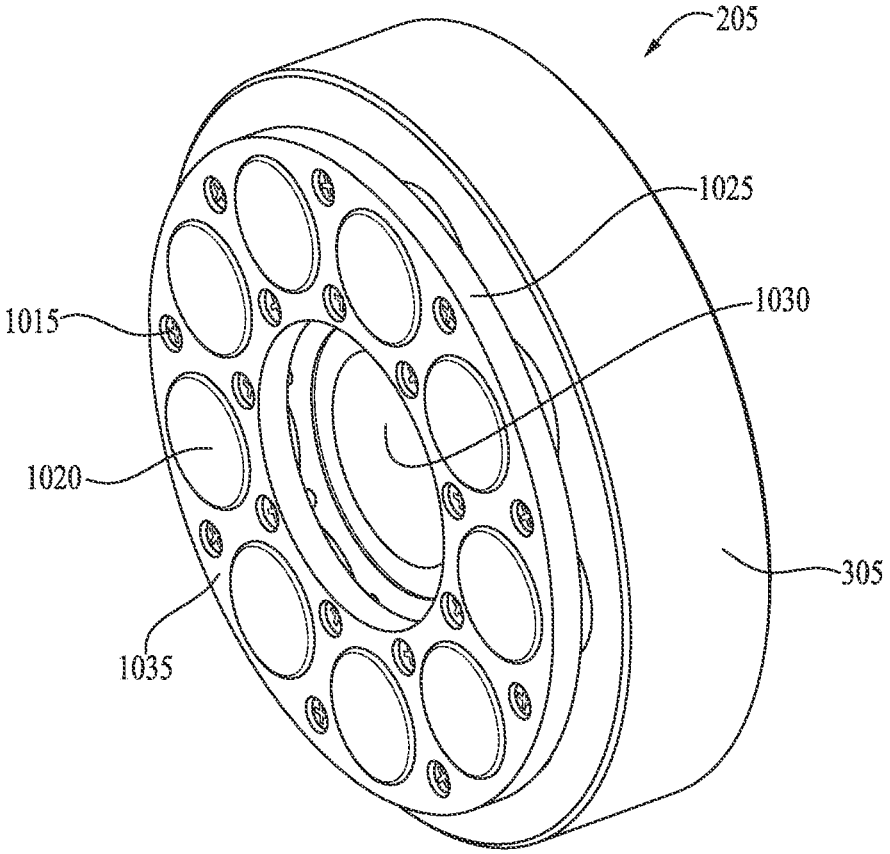
FIG. 10 is a perspective view of a thrust runner of an illustrative embodiment.

FIG. 10 is an exemplary thrust runner of an illustrative embodiment. As shown in FIG. 10, thrust runner 205 includes runner base 305, which may be keyed to shaft 220 (shown in FIG. 2). Runner locking plate 1025 is secured to base 305. In some embodiments, runner locking plate 1025 may be secured to runner base 305 with a series of screws 1015. Screws 1015 may additionally secure runner pads 1020 into place. A plurality of runner pads 1020 may be arranged circumferentially about runner locking plate 1025, for example as illustrated in FIG. 10. In some embodiments nine runner pads 1020 are arranged about runner locking plate 1025. In other embodiments, at least three runner pads 1020 are arranged about runner locking plate 1025. The size and number of runner pads 1020 may depend upon the size of the surface area of runner face 1035 and/or runner locking plate 1025. In some embodiments, runner pads 1020 include a circular surface area and are distributed uniformly around central opening 1030 of base 305, through which shaft 220 will run. Runner pads 1020 may be circular in surface area and be 9 mm, 16 mm, ½ inch, ⅝ inch, and/or ¾ inch in diameter. The number of runner pads 1020 may vary depending on the diameter of the overall bearing. In some embodiments runner pads 1020 may be made with different profiles other than round, for example a sector of a circle or a modified ellipse.

Figure 4:
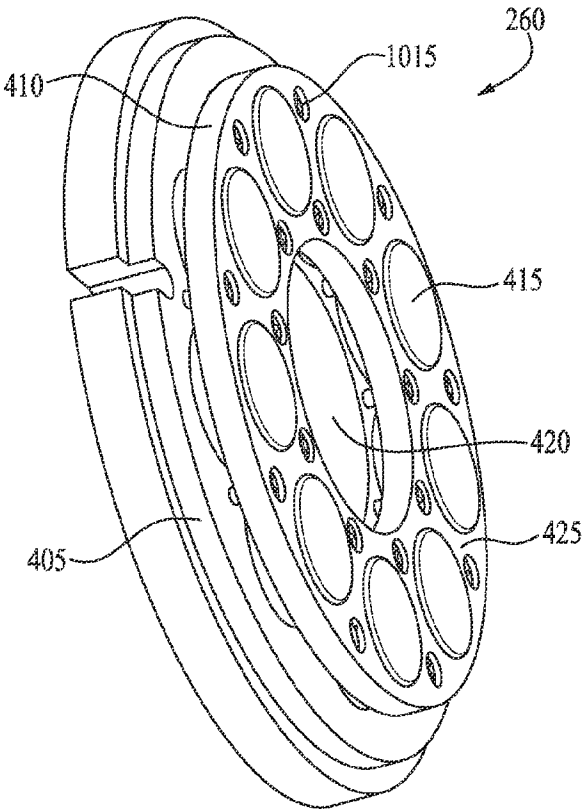
FIG. 4 is a perspective view of an illustrative embodiment of a thrust bearing.

An illustrative embodiment of thrust bearing 260 is shown in FIG. 4. Thrust bearing 260 may remain stationary during operation of the pump assembly. Thrust bearing 260 includes bearing holder 405, to which bearing locking plate 410 is secured. As with thrust runner 205, in some embodiments, bearing locking plate 410 may be secured to bearing holder 405 with a series of screws 1015. Screws 1015 may additionally secure bearing pads 415 into place. A plurality of bearing pads 415 may be arranged circumferentially about bearing locking plate 410, for example as illustrated in FIG. 4. In some embodiments nine bearing pads 415 are arranged about bearing locking plate 410. In other embodiments, at least three bearing pads 415 are arranged about bearing locking plate 410. The size and number of bearing pads 415 may depend upon the size and/or cross-sectional area of bearing face 423 and/or bearing locking plate 410. In some embodiments, bearing pads 415 include a circular surface area and are distributed uniformly around opening 420 of bearing holder 405. Bearing pads 415 may be circular in surface area and be 9 mm, 16 mm, ½ inch, ⅝ inch, and/or ¾ inch in diameter. The number of bearing pads 415 may vary depending on the diameter and/or circumference of the overall bearing. In some embodiments bearing pad 415 may be made with different profiles other than round, for example a sector of a circle or a modified ellipse.

Figure 5A:
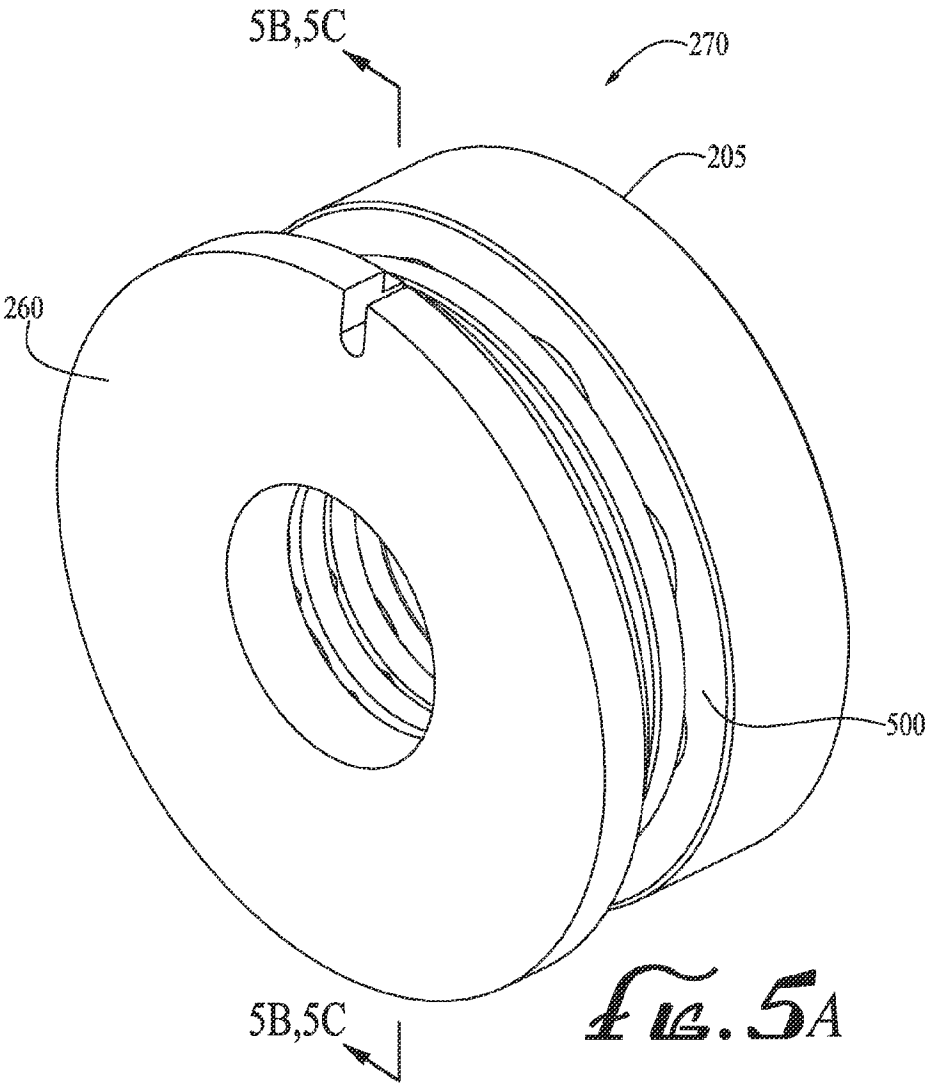
FIG. 5A is a perspective view of a bearing set of an illustrative embodiment.
Figure 5C:
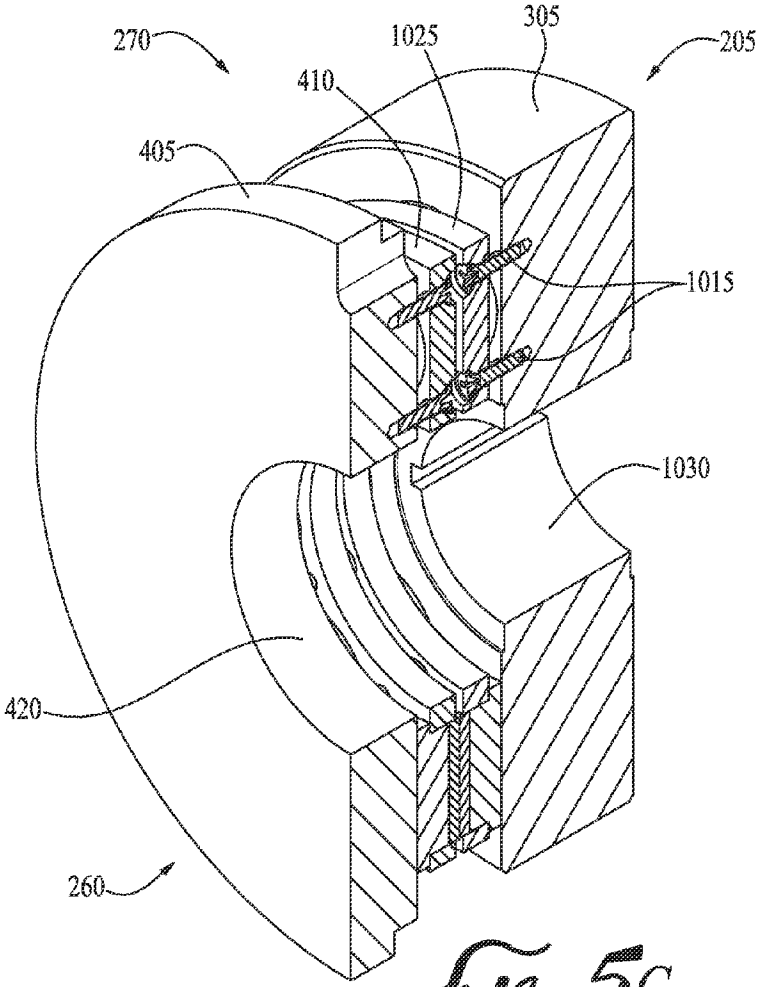
FIG. 5C is a cross sectional view taken along line 5C-5C of FIG. 5A of a bearing set of an illustrative embodiment.
Figure 5B:
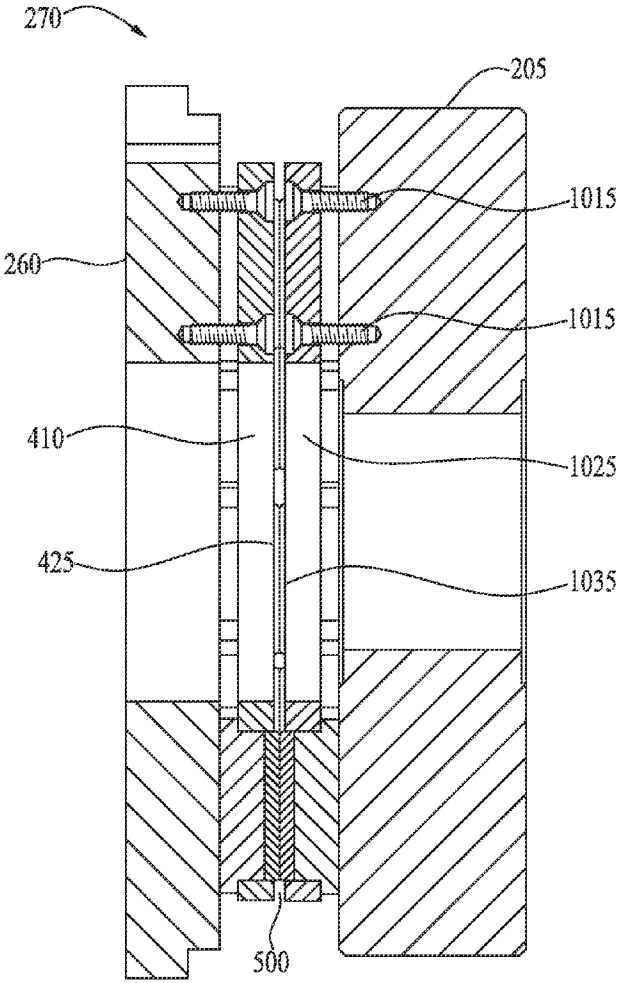
FIG. 5B is a cross sectional view taken along line 5B-5B of FIG. 5A of a bearing set of an illustrative embodiment.

FIGS. 5A, 5B and 5C are illustrative embodiments of thrust runner 205 paired with thrust bearing 260 to form bearing set 270. Faces 1035, 425 face towards each other, with space 500 in between them, space 500 sufficient to accommodate a hydrodynamic film. Space 500 may be between about 0.00001 to 0.005 inches separation due to temperature and fluid viscosity. Water and oil are considered incompressible fluids. As the velocity of thrust runner 205 increases, a fluid wedge may be created in space 500, which separates faces 1035, 425 from one another. The wedge may increase in height with the speed of rotating shaft 220 and thrust runner 205, providing greater load capacity. Thus, these illustrative embodiments reduce heat and friction in order to increase load capacity.

Figure 6:
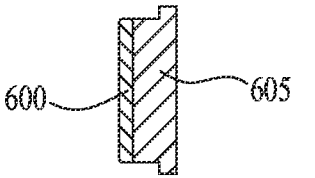
FIG. 6 is a sectional view of diamond coated pad of an illustrative embodiment.

FIG. 6 is an illustration of an exemplary pad of illustrative embodiments. Bearing pad 415 is illustrated in FIG. 6, but runner pad 1020 may similarly be as illustrated. Bearing and/or runner pad(s) 415, 1020 may be diamond coated, made of diamond, include leached diamond and/or comprise diamond. In some embodiments, bearing and runner pads 415, 1020 may comprise a polycrystalline matrix of inter-bonded, hard carbon-based crystals. For example, bearing and/or runner pads 415, 1020 may comprise a facing table of polycrystalline diamond integrally bonded to a substrate of less hard material, such as tungsten carbide and/or pad base 605, which pad base may be tungsten carbide. In embodiments including leached diamond, the leached diamond may include a polycrystalline matrix whereby the cobalt or other binder-catalyzing material in the polycrystalline diamond is leached out from the continuous interstitial matrix after formation.

Figure 7B:
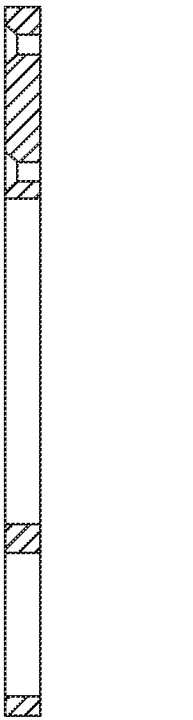
FIG. 7B is a cross sectional view taken along line 7B-7B of FIG. 7A of a locking plate of an illustrative embodiment.
Figure 7A:
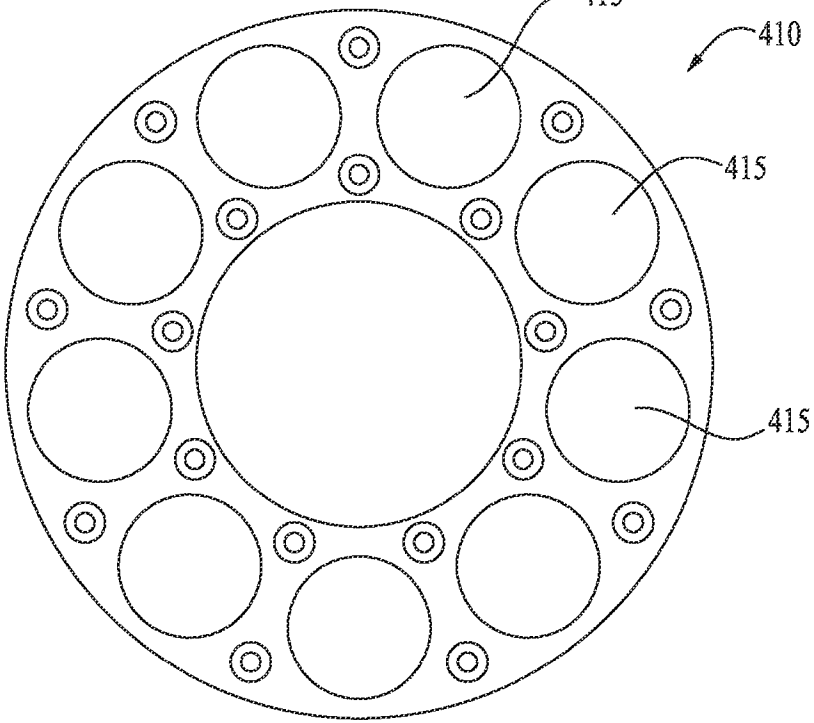
FIG. 7A is a schematic of a top view of a locking plate of an illustrative embodiment.

As shown in FIGS. 4, 7A and 10, bearing pad 415 and/or runner pad 1020 may have a circular cross-sectional area, or alternatively may have an elliptical or sector profile. Pad base 605 may be made of tungsten carbide and comprises a diamond coating 600. In certain embodiments, the diamond coating may be between about 0.070 and 0.080 inches thick, or may be between a few thousandths of an inch thick and 0.5 inch thick or more. In some embodiments, diamond coating 600 may be a diamond wafer that is silver brazed to pad base 605. In some embodiments, diamond coating 600 may be a diamond table.

Figure 8B:
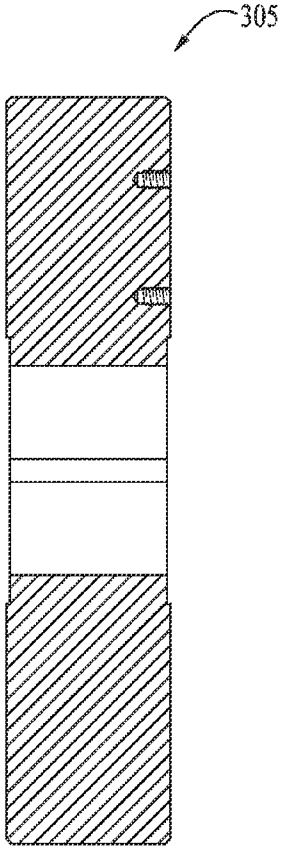
FIG. 8B is a cross sectional view taken along line 8B-8B of FIG. 8A of a thrust runner of an illustrative embodiment.
Figure 8A:
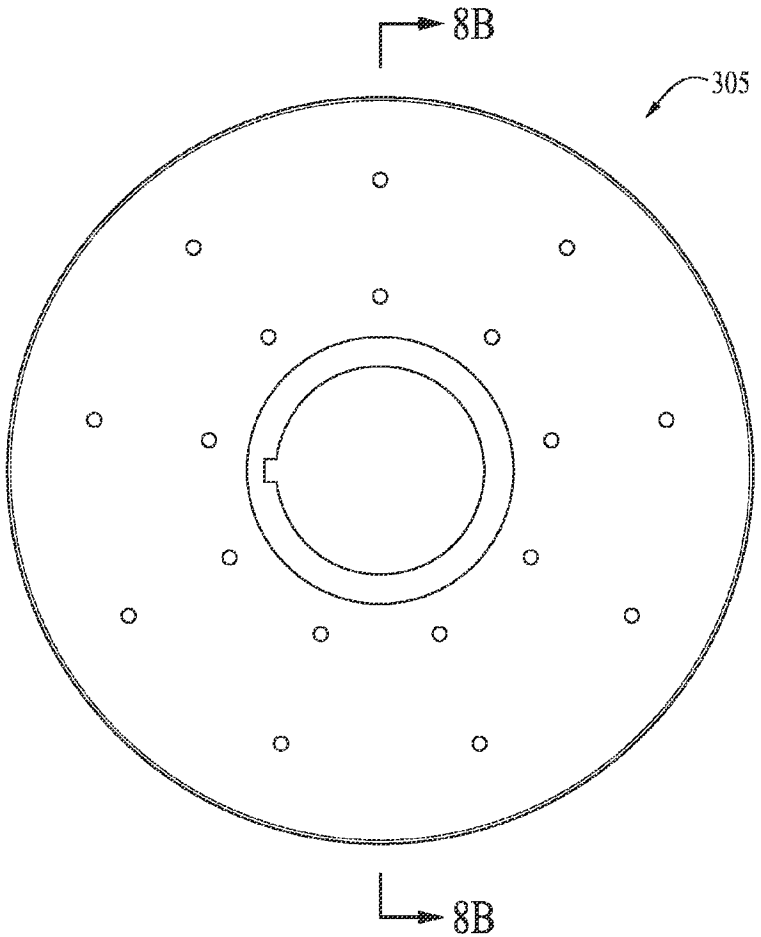
FIG. 8A is a top view of a thrust runner of an illustrative embodiment.
Figure 9B:
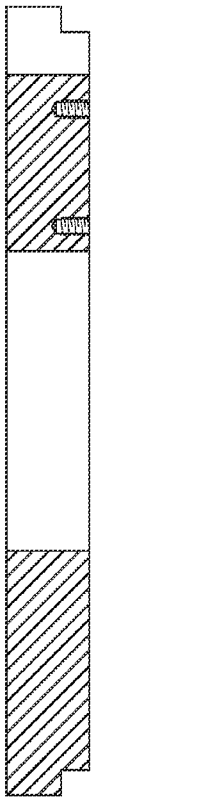
FIG. 9A is a top view of a thrust bearing of an illustrative embodiment.
FIG. 9 B is a cross sectional view taken along line 9B-9B of FIG. 9A of a thrust bearing of an illustrative embodiment.
Figure 9A:
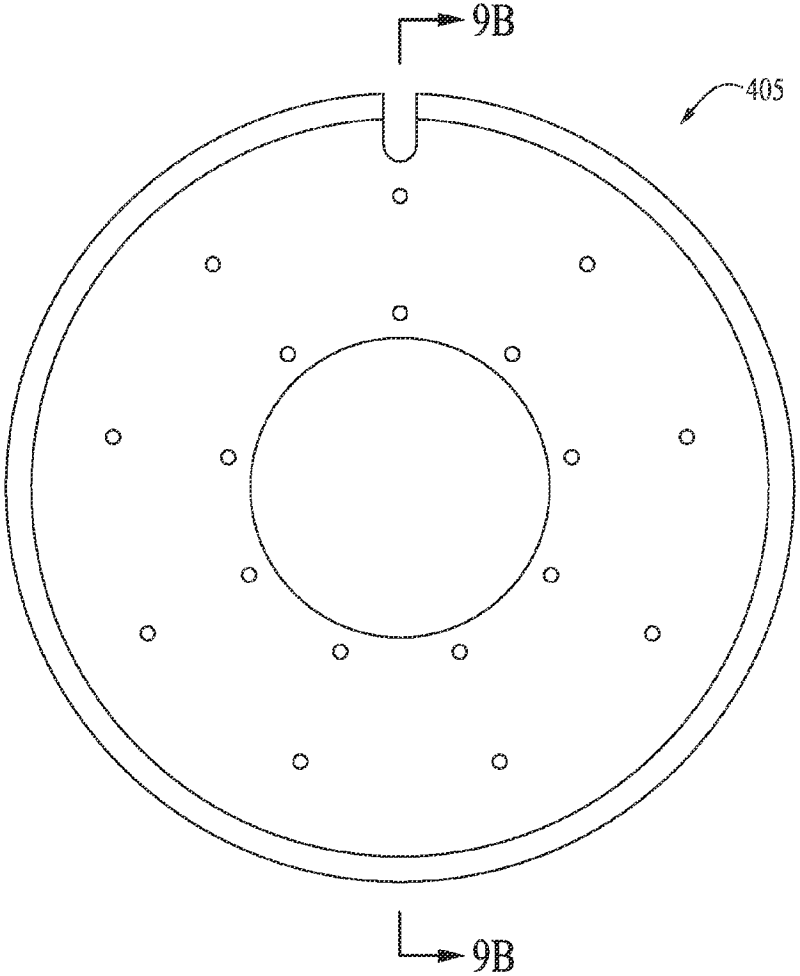

FIGS. 7A and 7B illustrate an exemplary embodiment of a locking plate. Bearing locking plate 410 is illustrated in FIGS. 7A and 7B, but runner locking plate 1025 may also be as illustrated. As shown in FIG. 7A, nine bearing pads 415 are evenly and circumferentially placed about locking plate 410. FIGS. 8A and 8B are an illustrative embodiment of runner base 305 of thrust runner 205. FIGS. 9A and 9B are an illustrative embodiment of bearing holder 405.

Operation of the Pump

Once the pump assembly has been positioned at the desired location, operation of the pump may be initiated. In instances where pumped fluid is employed as the hydrodynamic fluid, unlike motor oil, the water and/or pumped fluid may not provide boundary layer separation between faces 425 and 1035 when the ESP pump is first started. This is predominantly due to well fluid's relatively lower viscosity of about 1, the lack of additives in pumped fluid that would otherwise provide boundary layer lubrication and/or due to contaminants in the water or pumped fluid. Thus, water and/or pumped fluid would not typically be used as a hydrodynamic film in pump assemblies. As a result of the lack of lubrication, thrust runner 205 and thrust bearing 260 must endure contact of faces 425 and 1035 during pump start-up. Illustrative embodiments of thrust runner 205 and thrust bearing 260 are uniquely suited to solve this problem. Diamond coat 600 may endure face to face contact and prevent damage to thrust runner 205 and thrust bearing 260 prior to formation of the hydrodynamic film, due to the extreme hardness of diamond as employed in illustrative embodiments. Upon continued operation of the ESP pump, a hydrodynamic film may form in space 500 between faces 425, 1035 from the pumped fluid. In embodiments in which well fluid forms the hydrodynamic film, thrust runner 205 and thrust bearing 225 may handle increased axial loads due to the well fluid's improved heat transfer rate over motor oil which is used in traditional seals. In some embodiments, thrust runner 205 and thrust bearing 260, configured as described herein, may handle loads of about 5,000-10,000 pounds.

Motor Oil Vent Port

Figure 11:
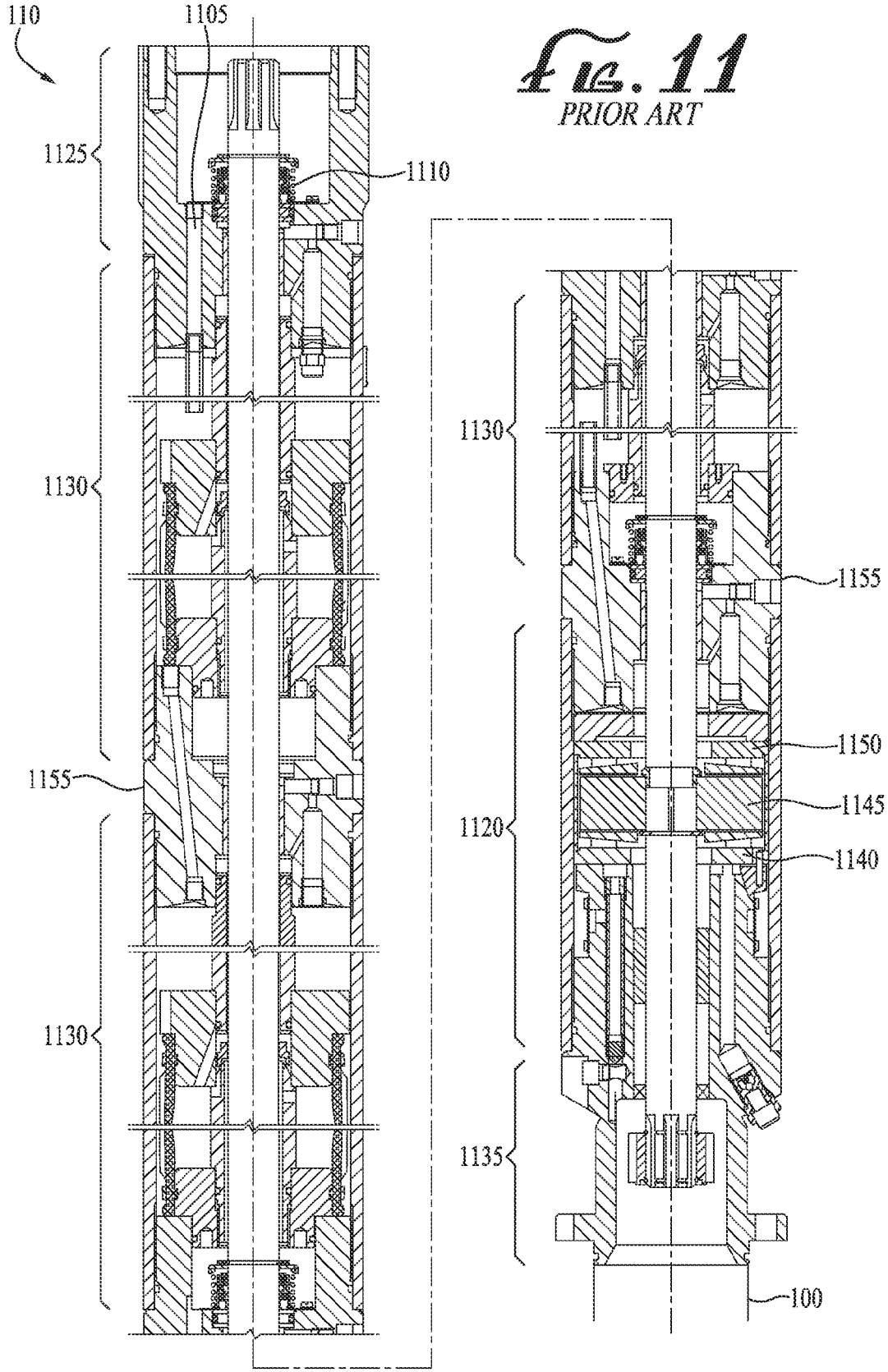
FIG. 11 PRIOR ART
FIG. 11 is a schematic of a conventional seal section of the prior art.
Figure 12B:
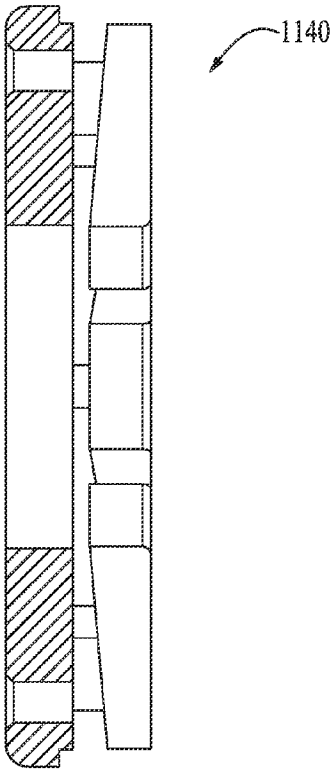
Fig. 12B PRIOR ART
FIG. 12B is a cross sectional view taken along line 12B-12B of FIG. 12A of a conventional thrust bearing of the prior art.
Figure 12A:
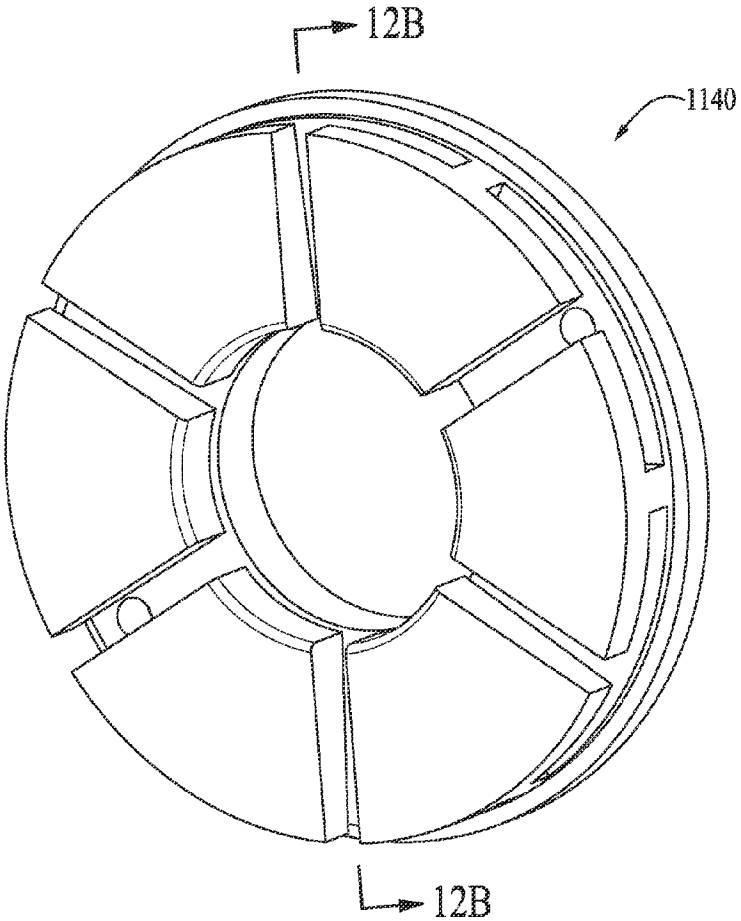
Fig. 12A PRIOR ART
FIG. 12A is a perspective view of a conventional thrust bearing of the prior art.

Returning to FIG. 2, vent port 290 may be located in the wall of head 280. This is in contrast to the conventional location at the bottom of the well bore as illustrated with conventional vent port 1105 in prior art FIG. 11. Moving vent port 290 from the well bore and connecting vent port 290 to communication port 295 radially through head 280 may prevent sand from plugging communication port 295 and/or decrease the amount of sand that accumulates on communication port 295. In addition, moving vent port 290 to the side of head 280, upstream of mechanical seal 250, eliminates or significantly reduces the risk that vent port 290 will clog with sand or other contaminants, which may reduce the risk of disturbing the pressure equalization of the seal and/or motor failure. As illustrated in FIGS. 2 and 3B, vent port 290 of illustrative embodiments may extend radially outward from communication port 295, and not extend substantially parallel to shaft 220, up through mechanical seal 250 as with conventional vent ports. As is well known to those of skill in the art, vent port 290 may include a check valve to allow expanding motor oil to exit seal section 200, but does not allow fluid to enter seal section 200.

Abrasion Resistant Trim

As shown in FIG. 3B, bushing set 310 may be comprised of sleeve 320 and bushing 315 located upstream of mechanical seal 250, in place of what would conventionally be a bronze shaft bushing. In some embodiments bushing set 310 comprises tungsten carbide. Sleeve 320 may be located on shaft 220 adjacent to bushing 315. In some embodiments, sleeve 320 rotates with shaft 220 by keying sleeve 320 to shaft 220. Sleeve 320 may be attached to the shaft using snap-rings at the top and/or bottom of sleeve 320. Sleeve 320 and bushing 315 may operate unimpeded in contaminated well fluid conditions in the present invention, whereas a bronze bushing of the prior art would fail under similar contamination. Bushing 315 may also provide radial shaft support. Even if mechanical seal 250 fails, bushing 315 may continue to provide radial shaft support, which might then prevent a failure of the pump assembly.

The inventions described herein may be suitable for a variety of types of seal sections 200. For ease of description, the embodiments described herein are in terms of an electrical submersible pump assembly, but those of skill in the art will recognize that the apparatus, system and method of the invention may be used to seal any type of electrical motor that may be exposed to fluid, sand and/or other contaminants. The inventions described herein prevent or reduce sand, well fluid and/or other contaminants from accumulating on mechanical seal 250 and/or bearing set 270, plugging vent port 290 and/or entering the electrical motor of a pump assembly. The risk of incipient buckling of the assembly may also be reduced or eliminated despite contaminated well fluid conditions (i.e., well fluid contaminated with sand). The inventions described herein improve the thrust handling (thrust absorbing) capabilities of ESP pumps. The bearing pads 415, runner pads 1020 and/or diamond coating 605 on plate faces allow the thrust bearings of illustrative embodiments to be placed closer to the pump, away from the motor and/or eliminate the need for the bearings to be placed in a cavity of clean oil. Use of pumped fluid to act as a hydrodynamic film in space 500 between the bearings improves the heat and thrust absorbing capabilities of the bearings, improving the function of the pump assembly and increasing its lifespan. Other types of pump assemblies, such as horizontal surface pumps or other pumps requiring improved thrust handling capabilities may benefit from the apparatus, system and method of the invention. Those of ordinary skill in the art will recognize that the bearing set of illustrative embodiments may be implemented in other locations of a submersible pump assembly where bearings may be used, for example, the thrust chamber of a horizontal surface pump. Using the apparatus, systems and methods of the invention, well fluid may assist in cooling components of the seal section without contaminating the electrical motor or disturbing the pressure equalization function of the seal section.

While the invention herein disclosed has been described by means of specific embodiments and applications thereof, numerous modifications and variations could be made thereto by those skilled in the art without departing from the scope of the invention set forth in the claims. The foregoing description is therefore considered in all respects to be illustrative and not restrictive. The scope of the invention is indicated by the appended claims, and all changes that come within the meaning and range of equivalents thereof are intended to be embraced therein.

What is claimed is:

1. A seal section for an electric submersible pump assembly comprising:

a rotatable shaft extending axially through a seal section;

a head tubularly encasing a top portion of the seal section and coupled to a centrifugal pump intake;

wherein the head further comprises:

a portion defining at least one well-fluid entrance aperture proximate to a bearing set, the at least one well-fluid entrance aperture extending radially through a wall of the head; and a portion defining at least one well-fluid exit aperture proximate to a mechanical seal and extending radially through the wall of the head;

the mechanical seal sealedly coupled to the rotatable shaft within the head; and the bearing set located between the centrifugal pump intake and the mechanical seal, the bearing set comprising a thrust bearing fixedly coupled to the head and a thrust runner keyed to the rotatable shaft.

2. The seal section of claim 1, wherein the thrust bearing comprises a first plurality of diamond-coated pads circumferentially disposed about a first locking plate, and the thrust runner comprises a second plurality of diamond-coated pads circumferentially disposed about a second locking plate.

3. The seal section of claim 1, further comprising a stationary sand barrier between the submersible pump intake and the mechanical seal, the sand barrier coupled to the rotatable shaft on an inner diameter and the head on an outer diameter.

4. The seal section of claim 3, further comprising an adapter pressed against the head, the adapter securing the sand barrier in place.

5. The seal section of claim 1, further comprising a tungsten carbide bushing set keyed to the shaft upstream of the mechanical seal.

6. The seal section of claim 1, wherein the head comprises portions defining a plurality of well-fluid entrance apertures and a plurality of well-fluid exit apertures, wherein the plurality of well-fluid entrance apertures and the plurality of well-fluid exit apertures are each disposed circumferentially about the head.

7. The seal section of claim 1, further comprising a motor-oil vent port located upstream of the mechanical seal and extending radially through the wall of the head from a communication port.

8. A electric submersible pump (ESP) system for pumping solid-laden fluid comprising:

a thrust chamber of an ESP seal section, the thrust chamber sealed from well fluid on a bottom side by a mechanical seal, the thrust chamber further comprising:

a rotatable shaft extending axially through the chamber;

a head tubularly encasing the thrust chamber, the head coupled to a centrifugal pump intake; and a diamond-coated hydrodynamic bearing set inside the thrust chamber between the centrifugal pump intake and the mechanical seal;

wherein well fluid enters and exits the thrust chamber through cross-drilled apertures in the head, and wherein the well fluid forms a hydrodynamic film between the diamond-coated hydrodynamic bearing set.

9. The system of claim 8, further comprising a check valve located upstream of the thrust chamber and extending radially through a wall of the head, the check valve fluidly coupled to a communication port and configured to vent expanding motor oil.

10. The system of claim 8, wherein the bearing set comprises a pad, the pad comprising leached diamond.

11. The system of claim 8, wherein the bearing set comprises a bearing pad, the bearing pad further comprising a facing table of polycrystalline diamond integrally bonded to a substrate.

12. The system of claim 8, further comprising a sand barrier secured within the head on a top side of the thrust chamber.

13. An apparatus for absorbing a thrust of an electric submersible pump (ESP) comprising:

an ESP configured to pump a well fluid;

an electric motor operatively coupled to the ESP, the motor operating to rotate a shaft of the ESP;

a seal section located between the ESP and the motor, the seal section comprising:

a stationary thrust bearing comprising a first diamond coated pad secured to a thrust bearing locking plate;

a thrust runner paired with the stationary thrust bearing to form a bearing set, wherein the thrust runner rotates with the shaft, the thrust runner comprising a second diamond coated pad secured to a thrust runner locking plate;

wherein the well fluid forms a hydrodynamic film between the first diamond coated pad and the second diamond coated pad during operation of the motor; and wherein the bearing set is located downstream of a mechanical seal in the seal section.

14. The apparatus of claim 13, wherein the seal section comprises a single stationary thrust bearing and a single thrust runner.

15. The apparatus of claim 13, wherein the thrust runner comprises at least three first diamond coated pads and the thrust bearing comprises at least three second diamond coated pads.

16. The apparatus of claim 13, wherein the second diamond coated pad of the thrust runner and the first diamond coated pad of the thrust bearing comprise a facing table of polycrystalline diamond integrally bonded to a substrate.

17. The apparatus of claim 13, wherein the hydrodynamic bearing set is located between a stationary sand barrier and the mechanical seal.

18. The apparatus of claim 17, wherein the bearing set is located in a thrust chamber in a head of the seal section.

19. The apparatus of claim 13, wherein the seal section further comprises cross-drilled apertures in a head of the seal section to permit entry and exit of well fluid.

20. The apparatus of claim 13, wherein the first and second diamond coated pads comprise leached diamond.

* * * * *